United States Patent [19]

Cluett

[11] Patent Number: 4,854,259

[45] Date of Patent: Aug. 8, 1989

[54] IMPROVED TRIM-TAB CONTROL SYSTEM FOR POWER BOATS

[75] Inventor: George Cluett, Sarasota, Fla.

[73] Assignee: Sta-Rite Industries, Inc., Milwaukee, Wis.

[21] Appl. No.: 257,942

[22] Filed: Oct. 14, 1988

[51] Int. Cl.[4] ..... B63B 1/22

[52] U.S. Cl. ..... 114/285; 74/479; 74/480 B; 74/491; 114/286

[58] Field of Search ..... 114/280, 284, 285, 286, 114/287, 152, 167; 74/479, 491, 500.5, 480 R, 480 B; 440/51

[56] References Cited

U.S. PATENT DOCUMENTS

| | | | |
|---|---|---|---|
| 3,577,948 | 5/1971 | Frey | 114/66.5 |
| 3,581,696 | 6/1971 | Ilom | 114/66.5 |
| 3,589,323 | 6/1971 | Kercheval | 114/66.5 |
| 3,628,486 | 12/1971 | Bennett | 114/66.5 P |
| 3,628,487 | 12/1971 | Bennett | 114/66.5 |
| 3,641,965 | 2/1972 | Schmiedel | 115/41 |
| 3,695,204 | 10/1972 | Bennett | 114/66.5 P |
| 3,760,758 | 9/1973 | Banner | 114/66.5 P |
| 3,814,044 | 6/1974 | Kercheval | 114/66.5 P |
| 3,977,349 | 8/1976 | Hummel | 114/66.5 P |
| 4,232,626 | 11/1980 | Kern | 114/285 |
| 4,261,278 | 4/1981 | Gaudin | 114/126 |
| 4,420,741 | 12/1983 | West | 340/29 |
| 4,597,742 | 7/1986 | Finkl | 440/61 |
| 4,644,893 | 2/1987 | Zepp | 114/286 |
| 4,718,872 | 1/1988 | Olson et al. | 440/1 |
| 4,742,794 | 5/1988 | Hagstrom | 114/286 |
| 4,800,721 | 1/1989 | Cemenska et al. | 74/491 |

*Primary Examiner*—Sherman D. Basinger

*Attorney, Agent, or Firm*—Peter N. Jansson, Ltd.

[57] ABSTRACT

An improved trim-tab control for boats has for each trim tab a yoke movably secured to a frame, a mechanical link between the yoke and the trim tab such that yoke and trim tab move in unison, a lever pivotable mounted with respect to the yoke and having first and second engagement surfaces, and a pair of switches on the yoke positioned for selective engagement with the lever surfaces to actuate a hydraulic device for moving the trim tab in opposite directions. Tab adjustment is carried out by continuing movement of the lever with respect to the yoke, while the yoke moves in response to such adjustment. A scale is secured adjacent to the lever such that the lever position provides visual indication of the trim-tab position.

20 Claims, 2 Drawing Sheets

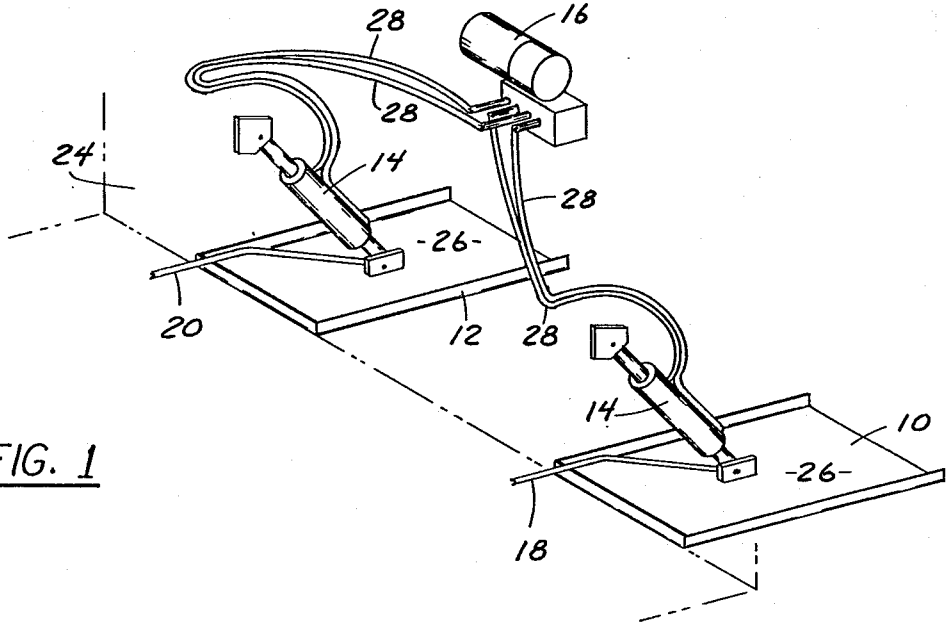
FIG. 1
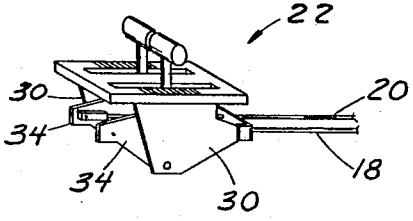

IMPROVED TRIM-TAB CONTROL SYSTEM FOR POWER BOATS

FIELD OF THE INVENTION

This invention is related generally to boat-leveling systems of the type with trim tabs and, more particularly, to control systems for trim tabs and indicators for trim-tab positions.

BACKGROUND OF THE INVENTION

Trim-tab systems have been used for many years to control the attitude of power boats as they move through the water, keeping them as reasonably level as possible. Trim tabs are devices which are adjustably mounted to the transom at the water level and have planar water-engaging surfaces. One tab is typically on the left side of the transom while another is on the right side. The two tabs are well spaced from the drive unit.

Trim tabs typically pivot about a horizontal axis such that their planar surfaces are either raised or lowered to engage the moving water in different ways. In most cases, adjustment of the trim tabs is accomplished by hydraulic means. The hydraulic means for moving a trim tab typically includes either one double-acting cylinder or a pair of single-acting cylinders (one for upward and the other for downward movement) extending between the top of the trim tab and the boat. Bi-direction, uni-directional or rotary pumps may be used in various hydraulic arrangements. In some cases, the drive cylinders have spring returns. Movement means other than hydraulic systems have and can be used, although hydraulic systems are preferred.

Trim tabs are controlled in the typical case by a pair of switches, one for each trim tab. These switches are often double-acting switches. If such a switch is pressed one way it actuates movement of the trim tab in one direction; if pressed the other way it actuates movement in the other direction. The switches are typically beside one another such that both may readily be operated in the same direction at the same time.

Many patents have been used on improvements in trim-tab systems including the following U.S. Pat. Nos.:

4,420,471 (West)
4,644,893 (Zepp)
4,742,794 (Hagstrom)
3,695,204 (Bennett)
4,232,626 (Kern)
3,581,696 (Ilon)
3,628,486 (Bennett)
4,261,278 (Gaudin)
3,641,965 (Schmiedel)
4,718,872 (Olson et al.)
3,577,948 (Frey)
3,589,323 (Kerchival)
3,628,487 (Bennett)
3,760,758 (Banner)
3,814,044 (Kercheval)
3,977,349 (Hummel)
4,597,742 (Finkl).

While trim tabs are widely used and significantly contribute to proper control of power-boat attitudes as they move over the water, a number of shortcomings and problems are present in trim-tab systems of the prior art.

One problem is that some trim-tab control systems do not provide the boat operator a clear indication of the positions of the trim tabs. With many systems it is often necessary to judge the trim-tab positions merely by the perceived attitude of the boat, or even in some cases by moving from the position of control in the boat toward the stern where it may be possible to view the trim tabs.

A variety of trim-tab indicator systems have been developed in the past, including the systems described in the West, Zepp and Hagstrom patents listed above. Some systems of the prior art are electrical or electronic in nature, and have display panels or gauges which may be on or near the dashboard or control panel of the boat. Some systems use a cable system to control a gauge. In such systems, properly controlling movement of the tabs while viewing such may sometimes be difficult. Furthermore, some systems can be susceptible to breakdown from damage to sensitive electrical parts by corrosion or other causes.

Most systems, however, do not have indicators of any kind. In such cases, as well as in some systems having position indicators, the operator often has no knowledge of how fast the trim tabs are moving during adjustment. Therefore, it is often quite difficult to adjust the trim tabs correctly during the first attempt. In some cases, the trim tabs overshoot the intended positions and further attempts at proper adjustment must be made.

There is another significant problem which exists when the operator has no knowledge or insufficient knowledge of the positions of the trim tabs or the rate of their movement during adjustment. The hydraulic system used for trim-tab movement can often be abused or strained by so-called "dead-heading," as attempted adjustment in one direction continues beyond the range of permissible motion. Dead-heading, which involves pumping by a hydraulic pump when no fluid is moving, is prone to occur when the common two-way switch system is used. This can be harmful to the hydraulic equipment.

Improvement is necessary in trim-tab control systems It would be desirable to have a trim-tab control system providing immediate information to the operator about both the position of the trim tabs and how fast they are moving during adjustment.

OBJECTS OF THE INVENTION

It is an object of this invention to provide an improved trim-tab system overcoming some of the problems and shortcomings of the prior art.

Another object of this invention is to provide an improved trim-tab control system providing an immediate visible indication of the position of each trim tab.

Another object of this invention is to provide a trim-tab control system which provides an indication of trim-tab position right at the control device.

Another object of this invention is to provide an improved trim-tab control system reducing or eliminating problems of overshooting in trim-tab adjustment.

Another object of this invention is to provide an improved trim-tab control system which allows a boat operator to sense the rate of trim-tab adjustment.

Another object of this invention is to provide an improved trim-tab control system which reduces or eliminates the problem of dead-heading in the hydraulic equipment used to move the trim tabs.

Another object of this invention is to provide an improved position indicator of trim-tab positions which does not require or include any gauge or display panel.

These and other important objects will be apparent from the descriptions of this invention which follow.

SUMMARY OF THE INVENTION

This invention is an improved trim-tab control system which overcomes certain shortcomings and problems of the prior art. The invention is useful in trim-tab systems of the type with a trim tab secured to the boat in position for adjustable contact with the water, means secured to the trim tab to move it in first and second opposite directions, typically up and down, and control means in the boat to actuate the movement means.

The improved trim-tab control system of this invention includes: a frame which is secured to the boat, typically near the captain's seat; a yoke movably secured with respect to such frame; means linking the yoke to the trim tab such that the yoke and trim tab move in unison; a lever mounted with respect to the yoke and having a limited range of pivot motion with respect to the yoke, the lever having first and second engagement surfaces; and first and second switch means, preferably microswitches, on the yoke in position for engagement with the first and second engagement surfaces, respectively.

Movement of the lever to selectively engage one of the switch means actuates the movement means, which is preferably a hydraulic cylinder, to move the trim tab in either the first or the second direction. Adjustment of the trim tab is carried out by continuing movement of the lever with respect to the yoke, during which time the yoke moves in response to trim-tab adjustment.

All or at least all highly preferred embodiments include a scale which is secured to the frame in position adjacent to the line of lever movement. The position of the lever with respect to the scale provides an accurate visual indication of the trim-tab position. This is provided without the need for significant electronic or electrical measurement equipment and indicators.

In highly preferred embodiments, the lever is pivotably mounted directly to the yoke itself. Such pivot connection is preferably at a point spaced from the pivot center of the yoke itself.

The first and second switch means limit the range of pivoting motion of the lever. Preferred embodiments of the control system of this invention include first and second stop means mounted to the yoke adjacent to the first and second switch means, respectively. Such stop means are in position to limit the application of lever pressure onto the switch means and thereby protect the switch means.

The means for movement of the trim tab itself is preferably a hydraulic cylinder and hydraulic supply means, as is well known in the art. Such hydraulic equipment is, however, controlled by the first and second switch means which are mounted on the yoke. The means mechanically linking the yoke and the trim tab preferably is a cable.

Certain highly preferred embodiments of this invention include means to center the lever between the first and second switch means on the yoke when manual pressure is not applied to the lever. Such centering means most preferably includes a pair of spring means on the yoke engaging the lever in opposite directions.

While this invention has been described with reference to control of a single trim tab, the invention is preferably used for both trim tabs of a power boat. In such cases, the invention includes a pair of yokes, levers and linkage means in side-by-side arrangement to control a pair of trim tabs on a boat.

Highly preferred embodiments for controlling a pair of trim tabs include a pair of side-by-side handles on the two levers. This arrangement allows the pair of trim tabs to be controlled by the single motion of a hand grasping both handles at once.

BRIEF DESCRIPTION OF THE DRAWINGS

FIG. 1 is a fragmentary perspective view of a power boat having a trim-tab control system in accordance with this invention.

DETAILED DESCRIPTIONS OF PREFERRED EMBODIMENTS

Figure 3:
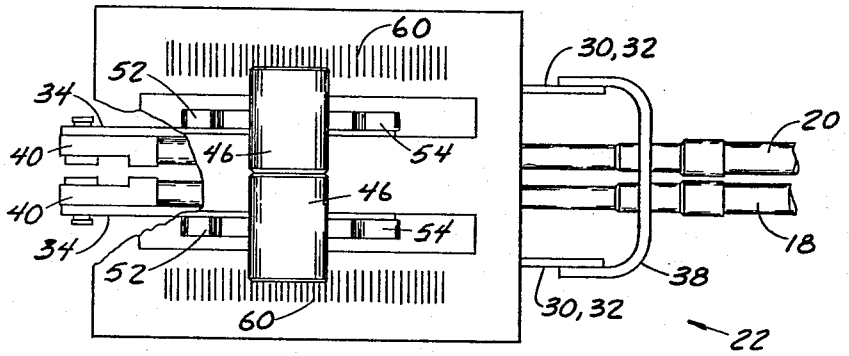
FIG. 3 is a top plan view of FIG. 2.
Figure 2:
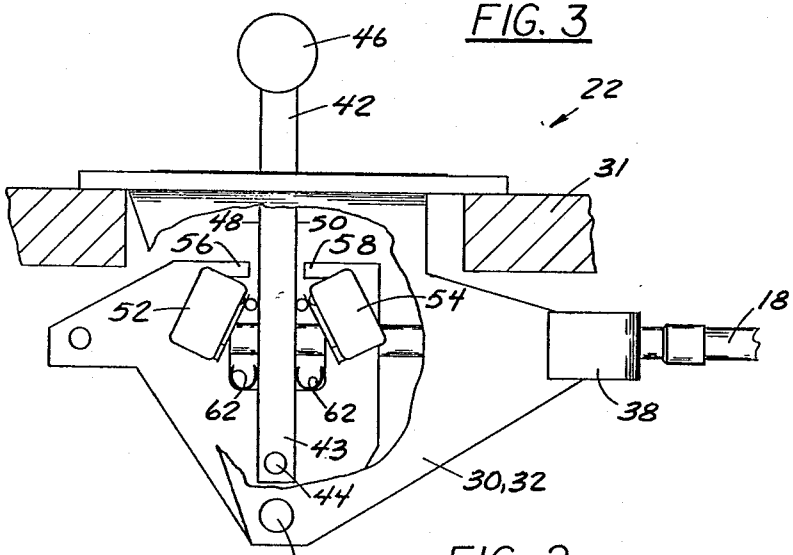
FIG. 2 is a side elevation of the principal portion of the trim-tab control system, with portions broken away to more fully illustrate the invention.

FIG. 1 illustrates an improved trim-tab system in accordance with this invention. The trim-tab system is generally of the type with left and right trim tabs 10 and 12, double-acting hydraulic cylinders 14 and a hydraulic pump 16 for feeding the cylinders. Hydraulic cylinders 14 serve as means to move trim tabs 10 and 12 in first and second opposite directions. The trim-tab system of this invention also includes left and right cables 18 and 20 and a control unit 22.

The hydraulic system used need not be described in detail. Many variations are possible within the scope of this invention. This invention deals primarily with the control apparatus and system.

Each of trim tabs 10 and 12 pivots, in the normal manner, about a substantially horizontal axis near the base of the transom 24 of a boat. Each hydraulic cylinder 14 extends between trim-tab top 26 and a position along transom 24 which is above the trim-tab pivot axis. Each hydraulic cylinder is fed by a pair of two hoses 28, one for each direction of movement of double-acting cylinder 14. Hydraulic pump 16 feeds cylinder 14 through hoses 28 as dictated by operation of control unit 22.

Control unit 22 includes a frame 30 which is secured in fixed position with respect to the dashboard 31 of the boat, or some other appropriate mounting surface, and includes a pair of parallel vertical walls 32 which extend downwardly from dashboard 31. A pair of side-by-side yokes 34 are located between frame walls 32 and are independently pivotably mounted with respect thereto on a pivot rod 36 extending between walls 32. Yokes 34 are used for mounting control levers, as hereafter described.

Each yoke 34 has attached to it one of the two cables 18 and 20, which are sturdy coaxial cables. Each cable 18 and 20 is attached at one end to just one of trim tabs 10 and 12 and at its other end to just one of yokes 34. A mounting bracket 38 secures the fixed outer portion of the coaxial cable to frame 34, while the movable inner portion of the cable extends to a forward end 40 which is attached to yoke 34.

The position of each yoke 34 is determined directly by the position of the corresponding trim tab at the other end of the cable linking the two together. Thus, each yoke 34 and its corresponding trim tab 10 or 12 move in unison. And, each yoke 34 and its corresponding trim tab 10 and 12 move independently of the other yoke and its corresponding trim tab.

Each yoke 34 and the apparatus attached thereto are essentially identical to the other yoke and its attached apparatus. Therefore, only a single yoke 34 and its supporting apparatus will be described.

For each yoke 34, a generally vertical lever 42 is pivotably mounted at its proximal end 43 to yoke 34 at a pivot point 44. Lever 42 extends upwardly to a handle 46 at the distal end thereof. Lever 42 includes first and second engagement surfaces 48 and 50 along its forward and rearward side, respectively.

Lever 42 has a limited range of pivot motion with respect to yoke 34. In the forward most position of lever 42, first engagement surface 48 engages and actuates a first microswitch 52. In the most rearward position of lever 42, second engagement surface 50 engages and actuates a second microswitch 54. Microswitches 52 and 54 are affixed to yoke 34 is position for such selective engagement and actuation.

Microswitches 52 and 54 are electrically connected through appropriate circuitry to properly actuate hydraulic pump 16. Depending on which switch is actuated, pump 16 will supply hydraulic cylinder 14 for movement in either of its first and second opposite directions.

Also attached to yoke 34 are first and second hard stop nubs 56 and 58. Stop nubs 56 and 58 are secured to yoke 34 adjacent to first and second microswitches 52 and 54, respectively, and are positioned to limit movement of lever 42 with respect to yoke 34 and microswitches 52 and 54. This serves to protect the microswitches from application of excessive pressure.

Extending across the top of control unit 22 in a forward-rearward direction, at positions below handles 46 and parallel and immediately adjacent to the paths of movement of levers 42, are a pair of gauges 60. Gauges 60 have markings on them relating to the positions of trim tabs 10 and 12 for corresponding positions of control levers 42 therealong. Gauges 60 remain in fixed position and levers 42 move along them. Gauges 60 provide a simple visual indication of trim-tab position.

Secured to each yoke 34 on either side of lever 42 are centering springs 62. Regardless of the position of yoke 34, centering springs 62 serve to move lever 42, when handle 46 is released, to a central position between microswitches 52 and 54. This serves to prevent any inadvertent actuation of the hydraulic system.

Figure 4:
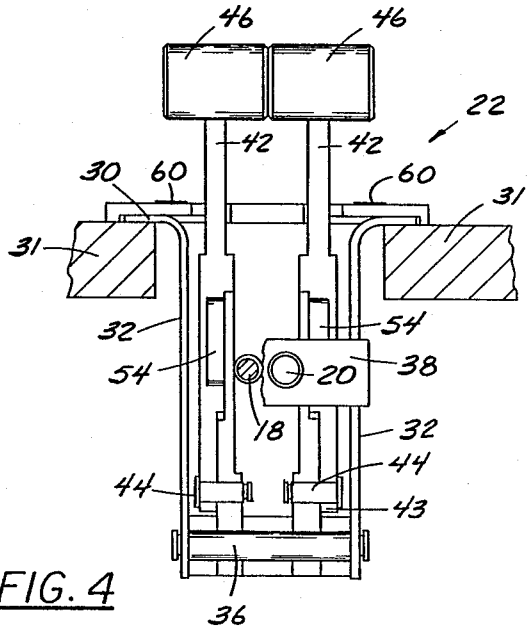
FIG. 4 is a right side elevation of FIG. 2, with portions broken away.

As illustrated best in FIG. 4, handles 46 are attached to levers 42 shown in a side-by-side arrangement. With such arrangement, handles 46 may together be grasped by one hand, thus allowing movement of both levers and both trim tabs 10 and 12 equally in either direction, as is often desired. Of course, levers 42 may be operated separately, as necessary, for independent positioning of trim tabs 10 and 12.

In operation, when it is desired to adjust the position of trim tabs 10 and 12, the handle of the lever 42 which corresponds to such trim tab is grasped and moved, either in a forward of a rearward direction. Such movement immediately actuates on of the microswitches, which in turn actuates hydraulic pump 16 to supply the appropriate end of the corresponding hydraulic cylinder 14. This causes the cylinder to move the trim tab in the desired direction.

As such trim tab movement occurs, the cable attached to such trim tab cause a corresponding movement in the yoke to which it is attached. This movement serves as a both manual and visual indicator of position of the trim tab, its direction of movement, and its rate of movement. Continued application of lever pressure by the operator allows the trim tab movement and corresponding yoke movement to continue. Termination of lever pressure allows the operator to feel whatever movement remains.

The position of lever 42 along its corresponding gauge 60 serves as a precise indicator of the trim tab position.

While the principles of this invention have been described in connection with specific embodiments, it should be understood clearly that these descriptions are made only by way of example and are not intended to limit the scope of the invention.

I claim:

1. In a trim-tab system of the type with means on the trim tab to move it in first and second opposite directions and means to control the movement means, the improvement wherein the control means comprises:

a frame;

a yoke movably secured with respect to the frame;

means to link the yoke to the trim tab such that the yoke and trim tab move in unison;

a lever pivotably mounted with respect to the yoke and having first and second engagement surfaces and a limited range of pivot motion with respect to the yoke;

first and second switch means on the yoke in position for engagement with the first and second engagement surfaces, respectively, to actuate the movement means to move the trim tab in the first and second opposite directions, respectively, whereby trim-tab adjustment is carried out by continuing movement of the lever with respect to the yoke and the yoke moves in response to trim-tab adjustment.

2. The trim-tab system of claim 1 further including a scale secured to the frame in position adjacent to the line of lever movement such that the position of the lever with respect to the scale provides visual indication of the trim-tab position.

3. The trim-tab system of claim 1 wherein the lever is pivotably mounted directly to the yoke.

4. The trim-tab system of claim 1 wherein the first and second switch means limit the range of motion of the lever.

5. The trim-tab system of claim 4 further including first and second stop means mounted to the yoke adjacent to the first and second switch means, respectively, in position to limit the application of lever pressure onto the switch means and thereby protect the switch means.

6. The trim-tab system of claim 1 wherein the movement means comprises a hydraulic cylinder and hydraulic supply means controlled by said first and second switch means.

7. The trim-tab system of claim 1 wherein the linkage means comprises a cable.

8. The trim-tab system of claim 1 further including means to center the lever between the first and second switch means on the yoke when manual pressure is not applied to the lever.

9. The trim-tab system of claim 8 wherein the centering means comprises a pair of spring means on the yoke engaging the lever in opposite directions.

10. The trim-tab system of claim 1 comprising a pair of yokes, levers and linkage, means in side-by-side arrangement for controlling a pair of trim tabs on a boat.

11. The trim-tab system of claim 10 further comprising a pair of side-by-side handles on the levers, whereby the pair of trim tabs can be operated by a single motion of a hand grasping both handles.

12. The trim-tab system of claim 11 further including at least one scale secured to the frame in position adjacent to the lines of movement of the levers such that the positions of each lever with respect to the adjacent scale provides visual indication of trim-tab position.

13. The trim-tab system of claim 12 wherein each of the levers is pivotably mounted directly to the yoke.

14. The trim-tab system of claim 13 wherein for each trim tab:

the first and second switch means limit the range of motion of the lever;

first and second stop means are mounted to the yoke adjacent to the first and second switch means, respectively, in position to limit the application of lever pressure onto the switch means and thereby protect the switch means; and a pair of spring means on the yoke engages the lever in opposite directions thereby to center the lever between the first and second switch means on the yoke when manual pressure is not applied to the lever.

15. The trim-tab system of claim 13 wherein the linkage means comprise cables.

16. The trim-tab system of claim 15 wherein for each trim tab:

the first and second switch means limit the range of motion of the lever;

first and second stop means are mounted to the yoke adjacent to the first and second switch means, respectively, in position to limit the application of lever pressure onto the switch means and thereby protect the switch means; and a pair of spring means on the yoke engages the lever in opposite directions thereby to center the lever between the first and second switch means on the yoke when manual pressure is not applied to the lever.

17. The trim-tab system of claim 16 wherein the movement means comprises a hydraulic cylinder and hydraulic supply means controlled by said first and second switch means.

18. In a boat trim-tab system of the type with a trim tab secured to the boat in position for adjustable contact with the water, means secured to the trim tab to move it in first and second opposite directions, and control means in the boat to actuate the movement means, the improvement wherein the control means comprises:

a frame;

a yoke movably secured with respect to the frame;

means linking the yoke to the trim tab such that the yoke and trim tab move in unison;

a lever pivotably mounted with respect to the yoke and having forward and rearward engagement surfaces;

forward and rearward switch means on the yoke in position for engagement with the forward and rearward engagement surfaces, respectively, to actuate the movement means to move the trim tab in the first and second opposite directions, respectively.

19. The trim-tab system of claim 18 further including a scale secured to the frame in position adjacent to the line of lever movement such that the position of the lever with respect to the scale provides visual indication of the trim-tab position.

20. The trim-tab system of claim 18 wherein the lever is pivotably mounted directly to the yoke.

* * * * *

UNITED STATES PATENT AND TRADEMARK OFFICE

CERTIFICATE OF CORRECTION

PATENT NO. : 4,854,259

DATED : August 8, 1989

INVENTOR(S) : George Cluett

It is certified that error appears in the above-identified patent and that said Letters Patent is hereby corrected as shown below:

Title page:

In the Abstract, line 4, change "pivotable" to --pivotably--.

Column 2, line 38, after "systems" insert --.--.

Column 4, line 59, change "34" to --30--.

Column 5, line 17, change "is" to --in--.

Column 5, line 58, change "of" to --or--.

Column 5, line 59, change "on" to --one--.

Signed and Sealed this

Thirtieth Day of July, 1991

*Attest:*

HARRY F. MANBECK, JR.

*Attesting Officer*

*Commissioner of Patents and Trademarks*